United States Patent [19]

Nobileau

[11] Patent Number: 4,842,061

[45] Date of Patent: Jun. 27, 1989

[54] CASING HANGER PACKOFF WITH C-SHAPED METAL SEAL

[75] Inventor: Philippe C. Nobileau, Paris, France

[73] Assignee: Vetco Gray Inc., Houston, Tex.

[21] Appl. No.: 152,516

[22] Filed: Feb. 5, 1988

[51] Int. Cl.[4] ..... E21B 17/08

[52] U.S. Cl. ..... 166/115; 166/208; 285/348

[58] Field of Search ..... 166/115, 208, 217; 285/917, 140, 141, 142, 143, 348, 338, 319, 133.2, 108; 277/30, 236

[56] References Cited

U.S. PATENT DOCUMENTS

| | | | |
|---|---|---|---|
| 3,797,864 | 3/1974 | Hynes et al. | 285/140 |
| 4,488,740 | 12/1984 | Baugh et al. | 285/351 X |
| 4,496,172 | 1/1985 | McEver et al. | 277/30 X |
| 4,634,152 | 1/1987 | Pettit | 285/140 X |
| 4,651,618 | 3/1987 | Johnson et al. | 166/115 |
| 4,665,979 | 5/1987 | Boehm, Jr. | 166/208 |
| 4,681,350 | 7/1987 | Gaita | 285/319 X |
| 4,719,971 | 1/1988 | Owens | 285/140 X |

*Primary Examiner*—William P. Neuder
*Attorney, Agent, or Firm*—James E. Bradley

[57] ABSTRACT

A packoff for a casing hanger for a subsea wellhead employs a one piece metal part with ancillary elastomer seals. A C-shaped metal seal links external metal lips. A locking section is located above the packoff. The locking section has a neck that allows it to buckle under sufficient downward force. When it deflects, a primary locking shoulder engages a locking shoulder of the casing hanger. At the same time, a secondary locking shoulder on the outer side of the locking section locks to a shoulder on the outer side to prevent the locking section from moving out of the locked position when an upward test pull is exerted.

6 Claims, 1 Drawing Sheet

CASING HANGER PACKOFF WITH C-SHAPED METAL SEAL

BACKGROUND OF THE INVENTION

1. Field of the invention

This invention relates in general to packoff assemblies located between a casing hanger and a wellhead, and in particular to a packoff assembly for a subsea well employing a metal seal.

2. Description of the Prior Art

In drilling subsea wells, concentric casings are hung. These protect the higher strata from the pressure and fluids which may be encountered at greater depths. Casing hangers are concentrically located to support the various casing strings.

It is necessary to contain the pressure within the inner casings so that the annular space outside of the inner casing does not receive the high pressure. For this purpose, it is known to pack off or seal annular space between the hanger bodies.

A particular seal for packing off the annular opening is shown in U.S. Pat. No. 3,797,864 Hynes et al, issued Mar. 19, 1974. This seal comprises an elastomeric ring interposed between two metallic rings. Each ring has a pair of lips extending toward the elastomer so that on axial compression the lips are forced outwardly into contact with the walls. A disadvantages of this packoff is that to seal high pressure, a high compressive load is required. This high compressive load is normally generated by the rotation of a packoff nut. High torque is required, which is further increased by the friction in the thread mechanism. Another problem is faced when the packoff is retrieved. The pulling from the upper ring often results in a rupturing or tearing of the elastomeric material, leaving half, or some part together with the lower metallic ring.

SUMMARY OF THE INVENTION

The packoff assembly of this invention employs a C-shaped shaped metal seal embedded within an annular elastomeric seal. The elastomeric seal is carried between upper and lower rings. The metal seal has upper and lower lips that extend to the outer wall of the elastomeric seal for sealing against the wellhead. The metal seal has a curved section extending between the lips. The central portion of the curved section engages the casing hanger.

A locking section locks the packoff in place. The locking section has vertical slots and a weak point located between its ends. When sufficient downward forces is applied, the locking section deflects. The downward force required is at least 20 percent greater than the force required to actuate the packoff. In the embodiment shown, the locking section deflects inward, although an outward deflecting locking section is feasible also. When deflected a locking surface on the inner side of the locking section engages a downward facing locking surface on the casing hanger to lock the packoff.

In the embodiment shown, a latch is located on the outer side of the locking section. When the locking section is deflected inward, a hook on the end of the latch engages a downward facing shoulder on the outer side of the locking section. This retains the locking section in the locked position during an upward pull test.

DESCRIPTION OF THE PREFERRED EMBODIMENT

Figure 1:
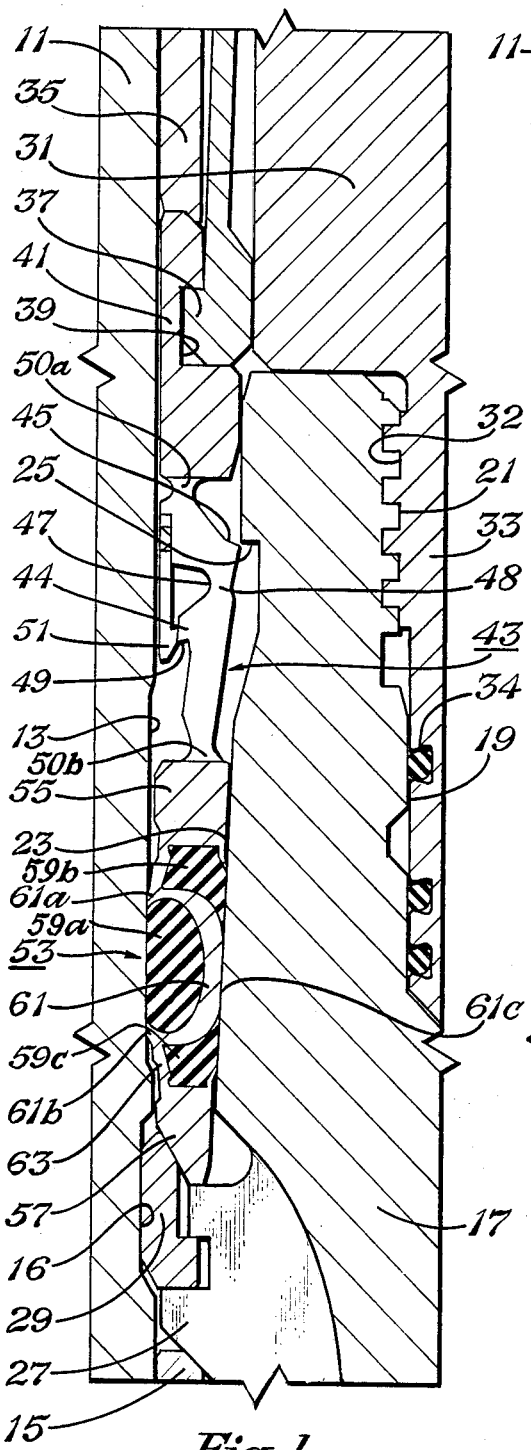
FIG. 1 is a vertical sectional view illustrating a packoff assembly constructed in accordance with this invention, the packoff landed, but not locked.

Referring to FIG. 1, wellhead 11 is conventional. It has a bore 13 with a landing shoulder (not shown) located therein. In the embodiment shown, an annular locking recess 16 is also located in bore 13. Wellhead 11 will be located on the sea floor. A riser pipe (not shown) will connect the wellhead 11 to a floating platform (not shown).

A casing hanger 17 is shown located in bore 13. It is shown landing at the upper edge 15 of a next lower casing hanger (not shown). The upper edge 15 serves as a landing shoulder for casing hanger 17. The next lower casing hanger may be supported on an even lower casing hanger, and the lowermost casing hanger will be supported on the landing shoulder in the wellhead.

Casing hanger 17 has an upper receptacle 19. In the embodiment shown, a set of left hand threads 21 are formed in the upper portion of the receptacle 19. A sealing surface 23 is formed on the exterior. The sealing surface is tapered or frusto-conical. It diverges outward when proceeding downward at an angle that is a few degrees relative to vertical.

In the embodiment shown, a locking surface or shoulder 25 is formed on the exterior of the casing hanger 17 a selected distance above the sealing surface 23 The locking shoulder 25 faces downward. A split ring 29 is mounted to the casing hanger 17 below the sealing surface 23. The split ring 29 when forced outward will engage the locking recess 16 in the wellhead 11. Bypass passages 27 are formed on the casing hanger 17 adjacent the split ring 29 to allow the return of fluid when cementing.

The casing hanger 17 is secured to a string of casing (not shown). Running tool 31 has a mandrel 33 that fits within the receptacle 19 of the casing hanger 17. In the embodiment shown, mandrel 33 has a set of threads 32 that engage the threads 21. Seals 34 seal within the receptacle 19.

The running tool 31 also has a drive sleeve 35. After the casing hanger 17 is landed, the running tool 31 can be operated to move the sleeve 35 downward relative to the casing hanger 17 with the weight of the drill string imposed on the sleeve 35.

A collet 37 is connected to the running tool 31. Collet 37 is biased inward. Collet 37 is adapted to engage a circumferential groove 39 formed in a drive ring 41. Collet 37 will move in unison with the sleeve 35. After the casing hanger 17 has been set, the running tool 31 is rotated to the right for retrieval of the running tool. The left hand threads 21 cause the mandrel 33 to disengage from the casing hanger 17. The mandrel 33 moves upward relative to the collet 17 and sleeve 35. The collet 37 moves inward and disengages from the drive ring 41.

The drive ring 41 is integrally secured to a locking section 43. The locking section 43 has a plurality of vertical slots 44. The elongated slots 44 extend the full length of the locking section 43 and are spaced circumferentially around the cylindrical locking section 43. In the embodiment shown, the locking section 43 has a primary locking surface or shoulder 45 faces upward to engage the locking shoulder 25 of the casing hanger 17.

An annular recess 47 is formed in the locking section 43. The recess 47 is on the outer side and results in a neck 48 of reduced thickness. The neck 48 is located radially inward from the line of downward force applied through the drive ring 41. A link portion 50*a* of the locking section 43 joins the drive ring 41 and is positioned above and radially outward from the neck 48. A link portion 50*b* of the locking section 43 joins the upper packoff ring 55 and is positioned below the neck 48. When positioned between the casing hanger 17 and wellhead bore 13, as shown in FIG. 1, the neck 48 will be located closer to the casing hanger 17 than to the wellhead bore 13. The line of downward force passes through the transverse section center of the link portion 50*a*. This creates a bending moment at the neck 48 when a downward force is exerted on the drive ring 41. The bending moment will cause the locking section 43 to yield at neck 48 and link portions 50*a*, 50*b*, and deflect inward if sufficient force is applied. When deflected inward, as shown in FIG. 2, the primary locking shoulder 45 will engage the locking shoulder 25.

Figure 2:
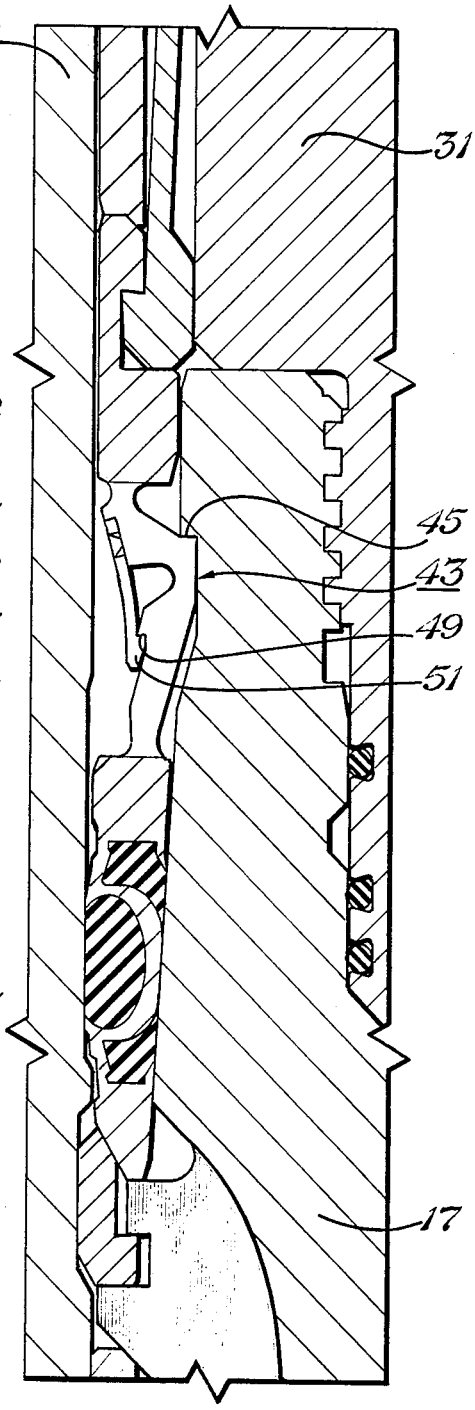
FIG. 2 is a view of the packoff assembly of FIG. 1, showing the packoff locked.

Means also exists for maintaining the locking section 43 in the locked position shown in FIG. 2 to allow an upward pull test. This includes a secondary locking shoulder 49 formed on the outer side of the locking section 43. Secondary locking shoulder 49 faces downward and is located lower than the primary locking shoulder 45. A collet or latch 51 is secured to the locking section 43 above the secondary locking shoulder 49. Latch 51 is biased inward and consists of a plurality of fingers separated by slots, each having a hook on the lower end. In the inoperative position shown in FIG. 1, the hook on the lower end of the latch 51 is located above the secondary locking shoulder 49. When the locking section 43 deflects inward, the latch 51 moves downward relative to the secondary locking shoulder 49. The bias on the latch 51 causes it to latch to the locking shoulder 49 as shown in FIG. 2. This prevents the locking section 43 from straightening when an upward pull test is applied. For retrieval, a sufficiently large upward force will cause the latch 51 to yield to allow the locking section 43 to straighten and the primary shoulder 45 to release from the casing hanger shoulder 25.

A packoff 53 is integrally carried on the lower end of the locking section 43. Packoff 53 has upper and lower rings 55, 57. Rings 55, 57 are solid metal rings with cylindrical inner and outer walls. An elastomeric annular ring comprised of three members 59*a*, 59*b* and 59*c* is bonded between the upper and lower rings 55, 57. The elastomeric members 59*a* and 59*b* have inner walls that are tapered to mate with the sealing surface 23 on the casing hanger 17. The outer wall of the elastomeric member 59*a* is cylindrical.

A metal seal member 61 separates the elastomeric members 59*b* and 59*c*. The metal seal member 61 is a solid annular member of deformable metal. It has a C-shaped cross-section. A pair of lips 61*a* and 61*b* are located on the outer side of the elastomeric members 59*a*, 59*b*, and 59*c*. The metal seal member 61 has a curved C-shaped section 61*c* that extends from the lips 61*a*, 61*b*. A central portion of this curved section 61*c* locates between the elastomeric member 59*b* and 59*c*. Metal webs 63 connect the lips 61*a*, 61*b* to the upper and lower rings 55, 57, respectively.

In operation, the casing hanger 17 will be secured to the upper end of a string of casing (not shown). The running tool 31 will be secured to the casing hanger 17 by means of the threads 32 of the mandrel 33 engaging the threads 21 of the casing hanger 17. The packoff 53 will be carried by means of the drive ring 41 and the collet 37 The packoff 53 will be carried in an upper position initially (not shown) spaced above the casing hanger 17.

The casing hanger 17 will land on the upper edge 15 of the next lower casing hanger. Then, cement is pumped down the casing string to cement the casing in place. Returns will flow up and bypass passages 27 and through the annular space between the casing hanger 17 and the wellhead 11.

After cementing has taken place, the packoff 53 is set. This is handled by operating the running tool 31 to lower the sleeve 35 and packoff 53. The collet 37 will remain in engagement with the drive ring 41 as it slides downward in contact with the running tool 31. The lower ring 57 will contact the split ring 29, causing it to lock within the locking recess 16.

The weight of the running string will cause some deformation of the elastomeric members 59*a*, 59*b*, 59*c* and metal seal member 61. The force imposed on the sleeve 35 will act through the drive ring 41 and locking section 43 to cause the initial sealing and deformation of the packoff 53. The elastomeric members 59*a*, 59*b*, 59*c* will seal on both the casing hanger sealing surface 23 and the wellhead bore 13.

The running tool 31 is operated to apply additional weight from the running string on the drive ring 41. The additional force causes the locking section 43 to buckle inward at neck 48 and link portions 50*a* and 50*b* as shown in FIG. 2. The primary locking shoulder 45 will engage the locking shoulder 25. The latch 51 will engage the secondary locking shoulder 49. About 20 percent more force is required to actuate the locking section 43 than the packoff 53, to assure setting of the packoff 53 before the locking section 43 deflects.

A pull test may be performed to assure that the locking section 43 has functioned properly. The latch 51 acts against the shoulder 49, preventing the locking section 43 from straightening during the pull test. The upward force is transmitted through the mated locking shoulders 25 and 45.

Hydraulic test pressure is applied to the annulus fluid locate above the packoff 53 and surrounding the running tool 31.

The running tool 31 may then be released from the casing hanger 17. Right hand rotation unscrews the threads 32 from the casing hanger threads 21. When the mandrel 33 moves upward and releases from the casing hanger 17, the collet 37 will be free to spring inward to release from the drive ring 41. The running tool 31 may then be pulled to the surface, along with the sleeve 35 and collet 37.

Upward force on the locking section 43 due to pressure in the annulus below the packoff 53 is reacted through the shoulder 25. Upward force due to pressure below the packoff 53 also creates a bending moment in the locking section 43, maintaining the locking shoulder 45 in engagement with the shoulder 25.

The packoff 53 can be retrieved by lowering a retrieving tool (not shown). Fingers or collets on the retrieving tool will engage the groove 39 in the drive ring 41. Application of sufficient upward force will overcome the latch 51 of the locking section 43. The locking section 43 will straighten. The primary and secondary locking shoulders 45, 49 will disengage, allowing he packoff 53 to be pulled to the surface.

The invention has significant advantages. The packoff provides elastomeric and metal-to-metal sealing in an efficient manner. High torque to energize the packoff is not required. The metal connection of the metal seal member between the upper and lower ring reduces the chance for portions of the packoff remaining in the well upon retrieval. The locking section has few parts and requires only downward force to actuate. After completion of the setting and locking phase, the locking section can be tested by an upward pull.

While the invention has been shown in only one of its forms, it should be apparent to those skilled in the art that it is not so limited, but is susceptible to various changes without departing from the scope of the invention. For example, the locking section could be constructed to deflect outward to engage grooves formed in the wellhead bore, rather than inward. The packoff could operate with different types of locking devices entirely. Different types of running tools can be used with the packoff and locking section.

I claim:

1. In a wellhead assembly having a wellhead within which a casing hanger lands, an improved packoff assembly for sealing between the wellhead and the casing hanger, comprising in combination:

a frusto-conical tapered sealing surface formed on the casing hanger;

metal upper and lower rings;

an annular metal seal member, the seal member having located between the upper and lower rings a single upper lip and a single lower lip, each facing outward for metal-to-metal sealing contact with the wellhead, the upper and lower lips being connected together with a single C-shaped curved section that has a single central portion facing inward for metal-to-metal sealing contact with the tapered sealing surface on the casing hanger, the upper and lower lips being connected to the upper and lower rings, respectively; and means for moving the upper ring downward relative to the lower ring to deform the metal seal member, the tapered sealing surface pushing the lips into sealing engagement with the wellhead.

2. In a wellhead assembly having a wellhead within which a casing hanger lands, an improved packoff assembly for sealing between a sealing surface in the wellhead and the casing hanger, comprising in combination:

a frusto-conical tapered sealing surface formed on the casing hanger;

metal upper and lower rings, each having an inner wall for contact with the sealing surface formed on the casing hanger and an outer wall for contact with the sealing surface in the wellhead;

an elastomeric member located between the upper and lower rings, having an inner wall tapered to seal against the sealing surface on the casing hanger and an outer wall adapted to seal against the sealing surface in the wellhead;

an annular metal seal member imbedded within the elastomeric member, the seal member having a single upper lip and a single lower lip located between the upper and lower rings at the outer wall of the elastomeric member for metal-to-metal sealing contact with the sealing surface of the wellhead, the upper lip being spaced below the top of the elastomeric member and the lower lip being spaced above the bottom of the elastomeric member;

the upper and lower lips being connected together with a single C-shaped curved section embedded within the elastomeric member that has a single central portion located at the inner wall of the elastomeric member for metal-to metal sealing contact with the sealing surface of the casing hanger, the upper and lower lips being connected to the upper and lower rings, respectively; and means for moving the upper ring downward relative to the lower ring to deform the elastomeric member and the metal seal member into sealing engagement with the sealing surfaces.

3. In a wellhead assembly having a wellhead within which a casing hanger lands, an improved packoff assembly for sealing between a sealing surface in the wellhead and a sealing surface on the casing hanger, comprising in combination:

a downward facing locking surface formed on one of the sealing surfaces;

an annular seal member adapted to locate between the sealing surfaces;

a locking section having upper and lower ends and extending upward from the seal member, the locking section having an upward facing locking surface on one side positioned between the upper and lower ends of the locking section;

means in the locking section actuable by downward force for causing the locking section to deflect the locking shoulder radially from an inoperative position to a locking position engaging the locking surface on the sealing surface;

a drive ring located above the seal member; and means for moving the drive ring downward to deform the seal member into sealing engagement with the sealing surfaces of the casing hanger and wellhead and to deform the locking section into the locking position.

4. In a wellhead assembly having a wellhead within which a casing hanger lands, an improved packoff assembly for sealing between a sealing surface in the wellhead and a sealing surface on the casing hanger, comprising in combination:

a downward facing locking surface formed on the one of the sealing surfaces;

an annular seal member adapted to be located between the sealing surfaces;

a drive ring located above the seal member;

a locking section having upper and lower ends and located between the drive ring and the seal member, the locking section having an upward facing locking surface positioned between the upper and lower ends of the locking section, the locking section having upper and lower areas of selected thicknesses;

a neck area located in the locking section between the upper and lower areas in the locking section, the neck area having less thickness than the thicknesses of the upper and lower areas of the locking section, the neck area being offset in a radial direction so as to locate closer to one of the sealing surfaces than the other when positioned between the casing hanger and wellhead;

the locking section having a plurality of vertical slots for enabling the locking section to deflect and bend at the neck area to move the locking surface radially from an inoperative position to a locking position engaging the locking surface on the sealing surface; and means for moving the drive ring downward to deform the seal member into sealing engagement with the sealing surfaces of the casing hanger and wellhead and to deform the locking section into locking position.

5. In a wellhead assembly having a wellhead within which a casing hanger lands, an improved packoff assembly for sealing between a sealing surface in the wellhead and a sealing surface on the casing hanger, comprising in combination:

a downward facing shoulder formed on the exterior of the casing hanger above the sealing surface;

an annular seal member adapted to located between the sealing surfaces;

a locking section having upper and lower ends and extending upward from the seal member, the locking section having an inner side with an upward facing primary locking shoulder positioned between the upper and lower ends of the locking section and a downward facing secondary shoulder on an outer side, the locking section having upper and lower areas of selected thicknesses;

a neck area located in the locking section between the upper and lower areas in the locking section, the neck area having less thickness than the thicknesses of the upper and lower areas of the locking section, the neck area being offset in a radial direction so as to locate closer to the casing hanger than the wellhead when positioned between the casing hanger and wellhead;

the locking section having a plurality of vertical slots extending through the neck area for enabling the locking section to deflect and bend at the neck area to move the primary locking shoulder radially inward from an inoperative position to a locking position engaging the locking shoulder on the casing hanger;

a drive ring located above the seal member;

means for moving the drive ring downward to deform the seal member into sealing engagement with the sealing surfaces of the casing hanger and wellhead and to deform the locking section into the locking position; and latch means latching the locking section in the locking position, the latch means having an inward biased hook carried on the outer side of the locking section above is in the inoperative position, the hook moving downward and engaging the secondary locking shoulder as the locking section moves to the locking position.

6. In a wellhead assembly having a wellhead within which a casing hanger lands, an improved packoff assembly for sealing between a sealing surface in the wellhead and a sealing surface on the casing hanger, comprising in combination:

a downward facing shoulder formed on the exterior of the casing hanger above the sealing surface of the casing hanger;

metal upper and lower rings;

an elastomeric member located between th®upper and lower rings, having an inner wall adapted to seal against the sealing surface on casing hanger and an outer wall adapted to seal against the sealing surface in the wellhead;

an annular metal seal member imbedded with the elastomeric member, the seal member having an upper lip and a lower lip located at the one of the walls of the elastomeric member for metal-to-metal sealing contact with one of the sealing surfaces, the upper lip being spaced below the top of the elastomeric member and the lower lip being spaced above the bottom of the elastomeric member, the upper and lower lips being connected together with a C-shaped curved section embedded within the elastomeric member that has a central portion located at the other wall of th®elastomeric member for metal-to-metal sealing contact with the other sealing surface, the upper and lower lips being connected to the upper and lower rings, respectively;

a locking section extending upward from the seal member and having upper and lower ends, the locking section having an upward facing locking surface on one side positioned between the upper and lower ends of the locking section;

means in the locking section actuable by downward force for causing the locking section to deflect the locking shoulder radially from inoperative position to a locking position engaging the locking surface on the sealing surface;

a drive ring located above the locking section; and means for moving the drive ring downward to deform the elastomeric member and metal seal member into sealing engagement with the sealing surfaces of the casing hanger and wellhead and to deform the locking section into the locking position.

* * * * *

UNITED STATES PATENT OFFICE

CERTIFICATE OF CORRECTION

Patent No. 4,842,061 Dated 6/27/89

Inventor(s) Philippe C. Nobileau

It is certified that error appears in the above-identified patent and that said Letters Patent is hereby corrected as shown below:

At Column 1, Line 29, "disadvantages" should be --disadvantage--;

At Column 1, Line 53, "forces" should be --force--;

At Column 1, Line 58, a comma should be inserted after "deflected";

At Column 2, Line 34, a period should be inserted after "23";

At Column 3, Line 1, after "45", insert --which--;

At Column 3, Line 24, "exists" should be --exist--;

At Column 4, Line 7, a period should be inserted after "37";

At Column 4, Line 13, the first occurrence of "and" should be deleted;

At Column 7, Line 16, after "to", insert --be--;

At Column 8, Line 12, "th" and the registered trademark symbol should be deleted and changed to --the--;

At Column 8, Line 29, "th" and the registered trademark symbol should be deleted and changed to --the--.

Signed and Sealed this

Seventh Day of August, 1990

*Attest:*

HARRY F. MANBECK, JR.

*Attesting Officer*

*Commissioner of Patents and Trademarks*